US005386398A

United States Patent [19]

Hiemke et al.

[11] Patent Number: 5,386,398

[45] Date of Patent: Jan. 31, 1995

[54] DISPLAY OF PARTLY RANDOMIZED TIME

[75] Inventors: Levan Hiemke, Boston, Mass.; Emanuel Kwak, New York, N.Y.

[73] Assignee: Massachusetts Institute of Technology, Cambridge, Mass.

[21] Appl. No.: 635,955

[22] Filed: Dec. 28, 1990

[51] Int. Cl.[6] ..... G04B 47/00

[52] U.S. Cl. ..... 368/10; 368/223; 368/12; 368/250

[58] Field of Search ..... 368/72, 75, 244, 245, 368/246, 248, 10, 119, 120, 29, 248; 273/86 C; 340/756

[56] References Cited

U.S. PATENT DOCUMENTS

| | | | |
|---|---|---|---|
| 4,698,783 | 10/1987 | Nishimuro et al. | 368/10 |
| 4,712,923 | 12/1987 | Martin | 368/29 |
| 4,868,412 | 9/1989 | Owens | 307/141 |
| 4,906,982 | 3/1990 | Gwynn | 368/10 |
| 4,951,237 | 8/1990 | Essenwanger | 366/721 |

OTHER PUBLICATIONS

Steven Harrington, Computer Graphics, 1987, pp. 424–435.

*Primary Examiner*—Ulysses Weldon
*Assistant Examiner*—Matthew Luu
*Attorney, Agent, or Firm*—Wolf, Greenfield & Sacks

[57] ABSTRACT

Apparatus for displaying data such as time or weight samples, comprising a data generator means, a pseudorandom number generator, a function generator for generating modified data samples functionally related to the original data samples and the pseudorandom numbers, and display means for displaying the modified data. The function generator may be an adder, for example. The data may represent time, weight, or another quantity.

8 Claims, 1 Drawing Sheet

DISPLAY OF PARTLY RANDOMIZED TIME

FIELD OF THE INVENTION

This invention relates to the field of timekeeping. More specifically, the invention relates to a timepiece which displays partly randomized time.

BACKGROUND OF THE INVENTION

One interesting aspect of human behavior is the difficulty some people have with respect to adhering to schedules. Individuals such as these often are late getting out of bed or arriving for appointments, for example, because they convince themselves or believe that they still have some time before they have to get up or before they have to leave for their destination. In simple terms, they procrastinate. Many of these people recognize that they procrastinate and will attempt to compensate by setting their alarm clocks, wrist watches, etc. to false times—typically ten to twenty minutes later than the correct time. This expedient may help for a short while, but the individual often then begins to employ a mental "reverse compensation". That is, he or she looks at the alarm clock that reads "7:00 a.m.", for example, and decides to sleep another ten minutes because he or she knows the device was set to read ten minutes ahead of the correct time, so the individual realizes the correct time is really 6:50 a.m. Conventional timepieces thus cannot be used effectively to break such a pattern of procrastination.

OBJECTS AND SUMMARY OF THE INVENTION

Therefore, it is an object of the invention to provide a time display system, such as a wristwatch or an alarm clock which will display, instead of the "correct" time value provided to it, a modified time value, the modified time value being derived from, but at times being different from, the correct time value.

Another object of the invention is to provide a time display system which will display, instead of the "correct" time value, a modified time value which is the correct time value plus or minus an offset value which is a pseudorandom value within a predetermined range.

A further object of the invention is to provide such a time display device in which the pseudorandom number of minutes which modifies the time display is changed from time to time, within the predetermined range, in a pattern not apparent to a user.

Such objects are achieved, in an exemplary apparatus including a time data generator means which provides digital data and display means for displaying digital data, by interposing an adder (i.e., an adder/subtractor) between the time data generator means and the display means. One input to the adder is the output of the time data generator means. Another input to the adder is obtained from a pseudorandom number generator which provides pseudorandom data values within a predetermined range. The pseudorandom data value may, if desired, be either a unipolar positive or negative number, or it may be bipolar). The output of the adder (i.e., the sum of the two data values) is supplied to the display as a modified data value.

Means also are shown for optionally varying the pseudorandom data value on a periodic or pseudorandom schedule, so that the user will not be able to compensate mentally for the introduced pseudorandom offset, and for selectively displaying unmodified time data values.

More generally, instead of an adder, a function generator may be employed, such that the modified time data value is some function of both the original data time value and a pseudorandom number.

BRIEF DESCRIPTION OF THE DRAWING

The foregoing and other objects of the invention and the manner in which they are achieved will become more apparent from the detailed description below, which should be used in conjunction with the accompanying drawing.

In the drawing.

DETAILED DESCRIPTION

For purposes of illustration, the invention will first be explained using, as an example, the display of time data by an alarm clock. Of course, the inventive concept now that it is recognized, may be applied to the display of time in other apparatus.

Figure 1:
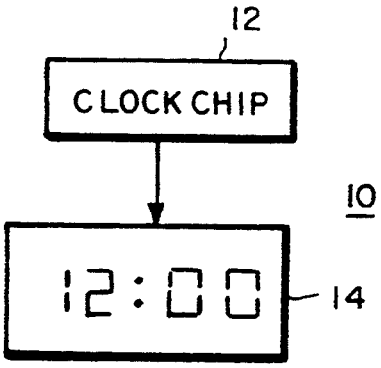
FIG. 1 PRIOR ART
FIG. 1 is a block diagram of a prior art time display system such as may be used, for example, in an alarm clock, wristwatch or other timepiece.

In FIG. 1, there is shown a simplified block diagram of a prior art alarm clock 10. The clock employs an integrated circuit clock "chip" 12 which drives a display 14 for displaying time data signals provided by the clock chip. Of course, controls are needed for allowing the user to set the time and the alarm time; for simplicity, and to avoid unnecessary obfuscation, these elements are not shown in the drawing.

Figure 2:
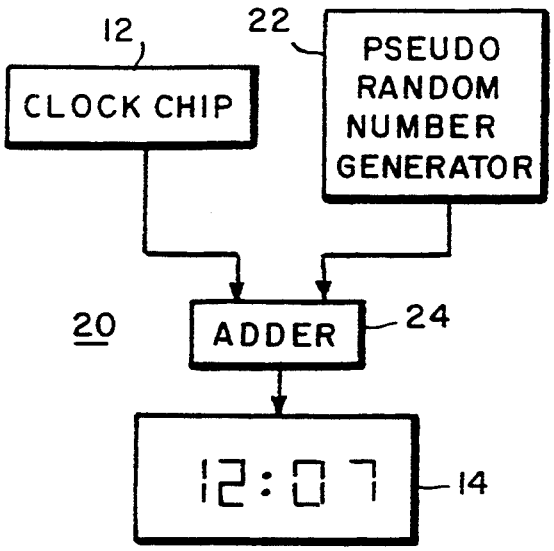
FIG. 2 is a block diagram of a first embodiment of the invention, illustrating its use to display partly randomized time.

FIG. 2 illustrates a simplified block diagram for a first embodiment, 20, of the present invention. A pseudorandom number generator 22 and an adder 24 augment the apparatus of FIG. 1. Blocks 22 and 24 may be implemented in any suitable manner, the implementation not being a limiting aspect of this disclosure. For example, each of the pseudorandom number generator and the adder may be implemented in dedicated hardware or in a software process executed by, e.g., a microprocessor. If the latter, the microprocessor may be one present in the clock chip. Irrespective of the implementation, the pseudorandom number generator 22 supplies a pseudorandom data value within a predetermined range (e.g., a range corresponding to $\pm 10$ minutes). The adder 24 adds this pseudorandom data value to the computed time data supplied by the clock chip 12 and supplies the sum to the display 14. By way of example, the clock chip may supply data representing a time of 12:00 and the pseudorandom number generator may supply data representing an offset, or modification, of $+7$ minutes. The displayed time will then be 12:07, as indicated in FIG. 2, instead of 12:00. The pseudorandom number (PRN) can be presented as a signed or unsigned value, at the implementer's discretion; however, if it is an unsigned unipolar value and there is a desire to have a displayed time which can be both earlier and later than the time data generated by the clock chip, means (not shown) also must be provided for supplying a pseudorandom add/subtract signal, or the equivalent, to adder 24; otherwise, the indicated time will always be faster or slower than clock chip time. For purposes of illustration, the assumption is made that the PRN generator 22 supplies a signed data value as a PRN.

Pseudorandom number generator 22 includes means (not shown) for establishing the range of its output values. This means may, again, be hardware or software, or some combination of the two. Also, the apparatus may be designed to have a single, fixed range or to accept a user-supplied range. Of course, the data value supplied by PRN generator 22 must change from time to time or the user will eventually know the difference between the correct time and the indicated time, and the desired effect will be lost.

Further, means must be provided for displaying the correct time when it is desired to set or reset the clock chip. This means can be implemented in a variety of ways, such as with a switch which can, when actuated, supply the clock chip output directly to the display, bypassing the adder and PEN generator; or by forcing the output of the PEN generator to zero.

Figure 3:
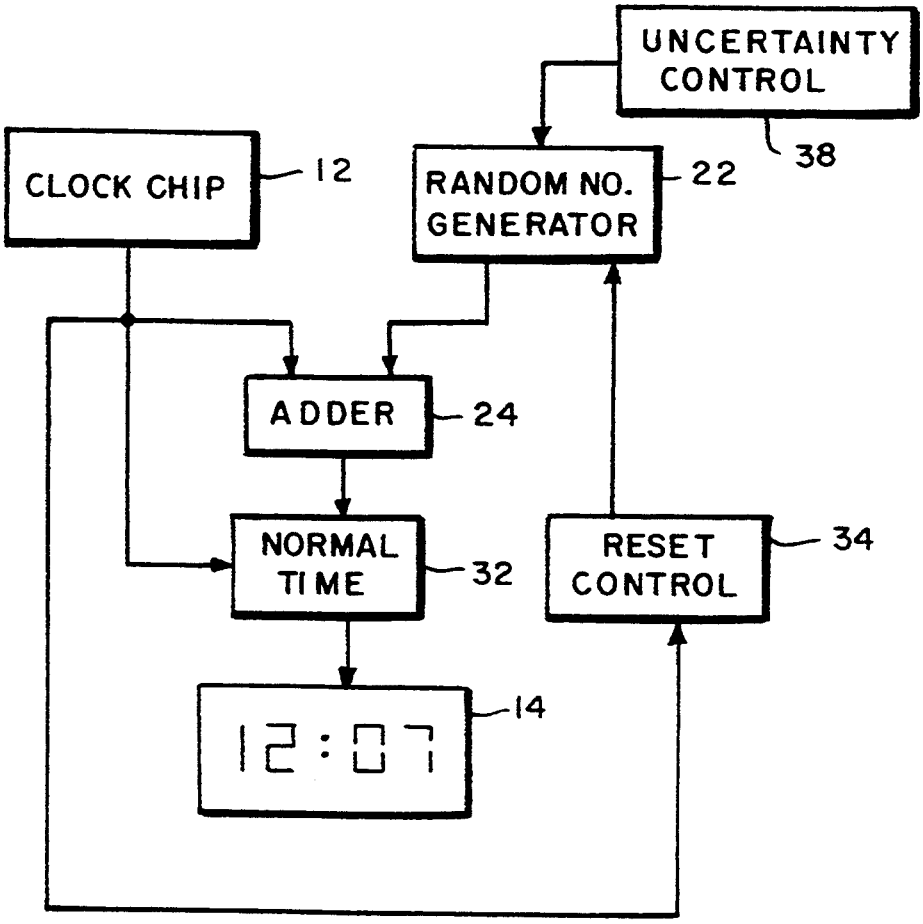
FIG. 3 is a block diagram of a second embodiment of the invention, also shown displaying partly randomized time, wherein user controls have been added for varying the range of the pseudorandom number generator and for selectively displaying originally unmodified data values.

A second embodiment, shown in FIG. 3, shows one way some of these details may be implemented. Clock chip 12 supplies "correct" time data not only to adder 24, but also to a Normal Time circuit 32 and a PRN generator reset control 34. The Normal Time circuit is a switch operable by the user to connect the display 14 either to the adder output or to the clock chip output. To frustrate attempts to override the pseudorandomness of the displayed time, the Normal Time circuit may be implemented as a momentary contact pushbutton switch to cause the clock chip output to be connected directly to the display when the switch is pressed, to display the correct time. Thus, the "correct" time will be displayed only so long as the user supplies pressure on the pushbutton.

The reset control 34, responsive to changes in the output from the clock chip, generates a reset signal on line 36 to the PRN generator 22. This causes the PRN generator to supply a new pseudorandom data value at its output. The changes in the clock chip output which cause the generation of the reset signal are not a limiting aspect of the invention. Circuitry or programming for the reset control readily can be designed (or written) to detect any desired interval or clock chip output pattern for triggering generation of the next pseudorandom data value. For example, the PRN generator may be reset once every minute, once every ten minutes, etc. The selection of an appropriate reset interval is a subjective implementation decision, dependent on the psychological effect to be achieved and the user's clock-watching habits. The reset rate may be fixed or user-selectable.

An optional uncertainty control 38 is shown. The uncertainty control is the input mechanism allowing the user to select the range for the PRN generator.

Having thus described the inventive concept and a number of exemplary embodiments, it will be readily apparent to those skilled in electrical engineering, instrumention and related arts that the inventive concept may readily be applied in a variety of time keeping applications. Displays of various types may be employed (such as conventional clock faces) even though only digital displays are illustrated. Further, though a fully digital system is disclosed, it is apparent that random values can also be used to modify analog signals, and the reference to "samples" is not intended to exclude this alternative. Thus the foregoing detailed description discusses embodiments by way of example only, not by way of limitation. It is understood and intended that the inventive concept will be used by others for diverse applications and that the implementations of specific embodiments may differ from those illustrated. Those skilled in the art will readily discern modifications and improvements which are intended to be suggested though not expressly stated herein. Accordingly, this invention is limited only by the following claims and equivalents thereto.

What is claimed is:

1. A timepiece comprising:

a. a time data source for supplying original time data values, each original time data value comprising a quantity representing the time at which said value is generated.

b. means for generating a pseudo-random value, for each original time data value, from within a predetermined range of possible pseudo-random values;

c. means for generating for each original time data value another time data value, called the modified time data value, the modified time data value being functionally related to the original time data value and the pseudo-random value according to a predetermined mathematical algorithm; and d. means for receiving and displaying the modified time data values.

2. The apparatus of claim 1 wherein the means for generating other time data values supplies, as the modified time data values, the sum of each original time data sample and said pseudorandom value.

3. The apparatus of claim 1 or claim 2 wherein the pseudorandom number is the same for more than one original time data value.

4. The apparatus of claim 1 or claim 2 wherein the pseudorandom number is changed for each original time data value.

5. The apparatus of claim 1 or claim 2 further including means operable by a user for selectively providing to the display means the original time data values instead of the modified time data.

6. The apparatus of claim 1 or claim 2 further including user operable means for setting the range of possible pseudorandom numbers.

7. A timepiece, comprising:

a. a time data source for supplying a sequence of original time values, each original time value comprising a quantity representing the time at which said value is generated;

b. means for generating a corresponding pseudo-random value for each original time value;

c. means for combining each original time value in the sequence with its corresponding pseudo-random value to produce corresponding combined time values such that neither the corresponding original time value nor the corresponding pseudo-random value can be determined from inspection of a combined time value; and d. means for receiving and displaying the combined time values.

8. The apparatus of claim 7 wherein each combined data value is a mathematical function of the corresponding, constituent original data value and pseudo-random values.

* * * * *